US006962159B1

(12) United States Patent
Adam

(10) Patent No.: US 6,962,159 B1
(45) Date of Patent: Nov. 8, 2005

(54) HAIR STYLER

(76) Inventor: Michael Adam, 1075 Alameda de Las Pulgas, Belmont, CA (US) 94002

( * ) Notice: Subject to any disclaimer, the term of this patent is extended or adjusted under 35 U.S.C. 154(b) by 217 days.

(21) Appl. No.: 10/237,536

(22) Filed: Sep. 7, 2002

(51) Int. Cl.[7] ..... A45D 6/02
(52) U.S. Cl. ..... 132/210; 132/238; 57/29
(58) Field of Search ..... 132/210, 212, 132/237, 238, 240, 239, 242, 271; 57/4, 29, 28

(56) References Cited

U.S. PATENT DOCUMENTS 2,586,103 A * 2/1952 Smith ..... 132/238
2,935,070 A * 5/1960 Auz ..... 132/229
3,057,363 A * 10/1962 Talbot ..... 132/211
4,166,472 A * 9/1979 Battaglia ..... 132/229
5,119,847 A * 6/1992 Powell et al. ..... 132/226

* cited by examiner

*Primary Examiner*—Todd E. Manahan
(74) *Attorney, Agent, or Firm*—Robert Samuel Smith

(57) ABSTRACT

A cone mounted coaxially on a hand held motor. The cone has an open slot arranged to permit sliding a lock of hair through the slot. The lock wraps around the cone thereby forming a roll of hair when the motor is energized to rotate the cone. The cone is then separated from the roll and the hair is secured in place by a pin. A clamp/hook on the apex of the cone is provided to engage the free end of a lock of hair, a twist of hair (akin to a cable) is formed when the cone is rotated.

6 Claims, 5 Drawing Sheets

HAIR STYLER

FIELD OF THE INVENTION

This invention relates to devices and methods for styling women's hair and particularly to a device with which a hair styler is enable to form unusual and intricate hair styles.

BACKGROUND AND INFORMATION DISCLOSURE

Hair styling is an art form that has been practiced since the beginning of civilization. The average woman typically has a strong interest in arranging her hair in a design that is attractive, unique and "stylish".

By stylish is meant that certain hair styles have characteristics that identify arrangements that are very similar to one another and which are commonly seen during certain periods throughout history or which have been adopted by a particular ethnic or cultural group.

By unique is meant that, within any style, the wearer still endeavors to be distinguishable from other members wearing the same style.

Numerous tools have been developed with which the hair stylist is enabled to arrange hair according to the desired style.

These include "rollers" around which the hair is wrapped a then treated with a solution to retain the curls after the rollers are removed. "Curlers" are elongated heatable irons around which hair is wrapped and permitted to "set".

U.S. Pat. No. 6,318,378 discloses a hair styling device for twisting locks of hair, including a main body and at least two "hair grabbers" for respectively grabbing separate locks of hair. Each grabber is mounted on respective twisters, each of which rotates to form twists of hair.

U.S. Pat. No. 6,109,275 discloses a hair twisting device having a pair of hair gripping holders which grip two wisps of hair and which are rotatably mounted within a housing The housing contains a worm gear which rotate the hair holders with respect to each other.

None of the devices of the disclosed art are disposed to provide the braids and twists that characterize styles that are desired in the present world of fashion. Such hair styles are presently formed only by laborious and painstaking effort by a skilled practitioner of the art of hair styling.

SUMMARY OF THE INVENTION

It is an object of this invention to provide a tool which a hair stylist can use, according to methods of the invention, to form a variety of unique hair styles.

In the context of this specification, a "twist" of hair will be interpreted as meaning a lock of hair that is analogous to a length of multi-strand cable. A "roll" of hair is analogous to a formation of hair formed by wrapping a lock of hair around and along a bar and then sliding the bar out of the interior of the roll of hair.

This invention is directed toward a truncated cone whose base is rotatably mounted on a handle section that serves as a handle and a housing for a motor coupled to rotate the cone about its axis. The cone has an elongated slot extending through the cone, The slot has an opening in the side of the cone near the base so that locks of hair can be captured in the slot and wrapped around the outside of the cone by rotating the cone. The motor is reversible so that the lock of hair can be wrapped clockwise or counter clockwise.

In another embodiment, a small wire hook is mounted on the apex of the cone and extends in the axial direction of the cone. In another embodiment, a springloaded clamp is positioned on the apex of the cone.

According to the invention, to form a roll of hair, a section of a lock of hair close to the scalp is wound around the main body of the cone and the cone is then disengaged from the lock.

To form a twist of hair, the end of a lock is attached to the clamp/hook and the motor is turned on thereby forming the twist of hair.

BRIEF DESCRIPTION OF THE DRAWINGS

The Patent file contains at least one drawing executed in color. Copies of this patent with color drawings will be provided by the Patent Officem upon request a payment of the necessary fee.

DESCRIPTION OF A BEST MODE

Figure 1:
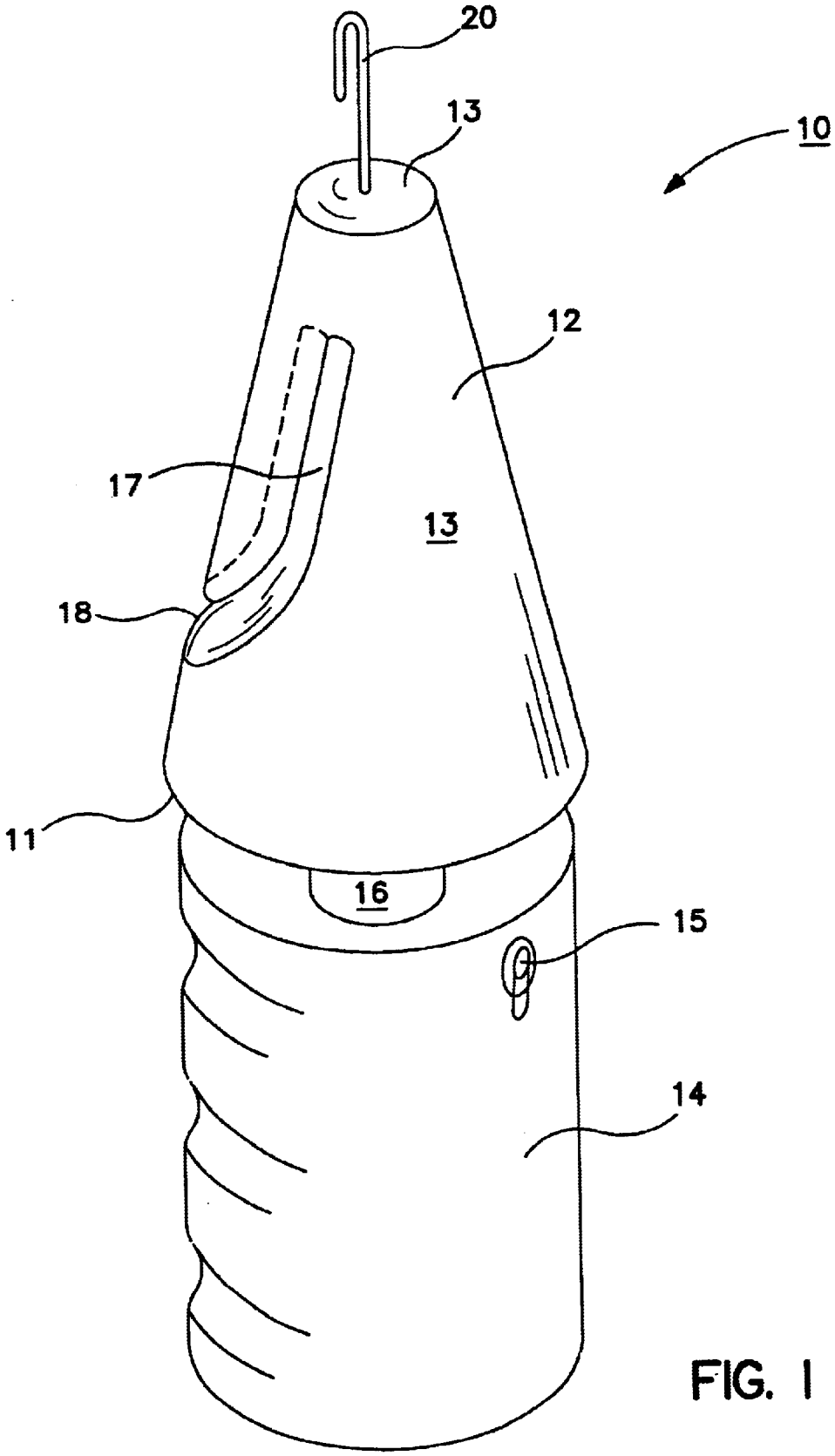
FIG. 1 shows the hair styler of this invention.

Turning now to a discussion of the drawings, FIG. 1 shows the hair styler 10 of this invention.

There are shown a truncated cone 12 and a handle section 14. The cone 12 has a conical surface 13 with a base surface 11 on one end and an apex 13 on the other end. The handle section 14 houses a motor (motor not shown). The motor is preferably driven by a battery positioned inside the handle section 14. The shaft 16 of the motor protrudes from the handle section 14.

The base 11 of the cone 12 is mounted on the protruding shaft 16 so that axial rotation of the cone is under control of the user by a switch 15 on the handle that permits stopping and starting rotation and rotation in either one of two directions.

The cone 12 has a elongated slot 17 extending axially and entirely through the cone 12 with an opening 18 in the side of the cone 12 near the base 11.

In one embodiment, a hook 20 is mounted on the apex end of the cone as shown in FIG. 1.

Figure 2B:
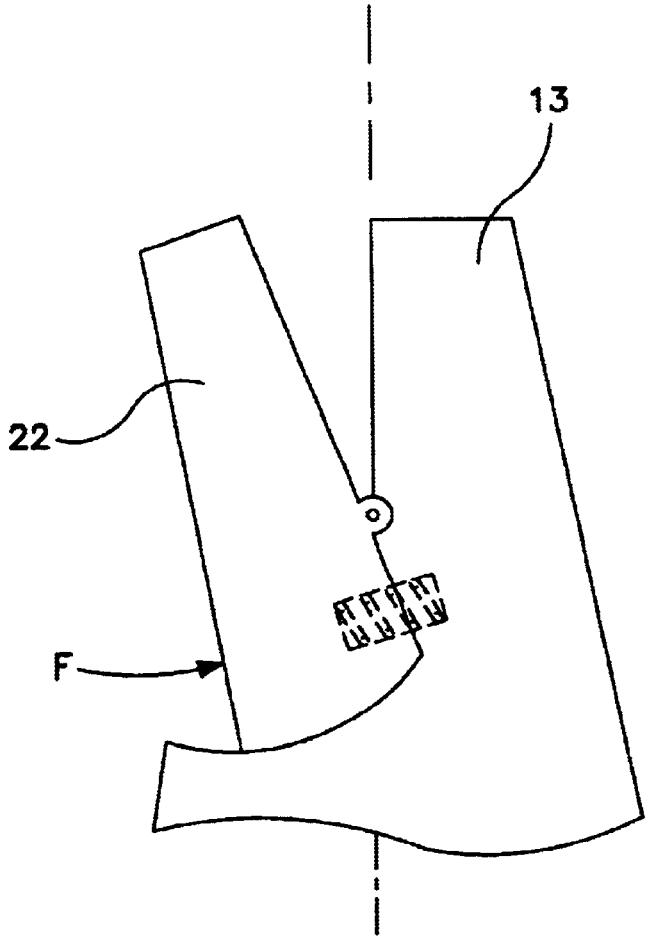
FIG. 2*b* shows a the clamp open.
Figure 2A:
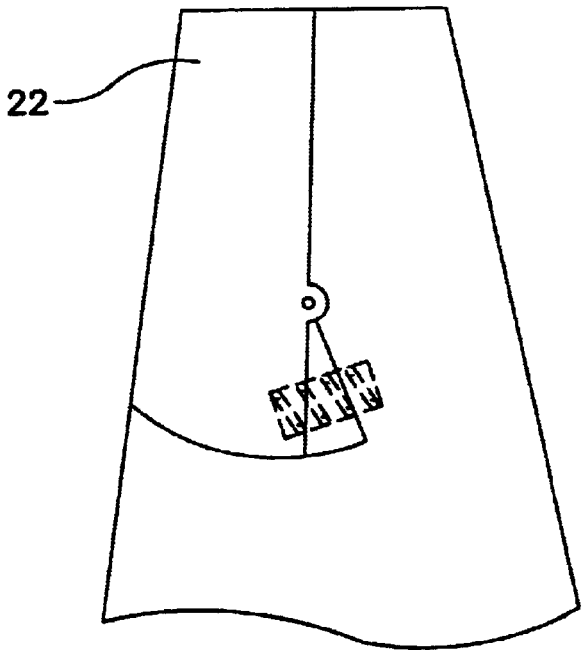
FIG. 2*a* shows a a clamp mounted on the apex of the cone.

In another embodiment, a springloaded clamp 22 is mounted on the apex end of the cone. The clamp 22 is shown closed in FIG. 2A. The clamp 22 is opened by applying force F, as shown in FIG. 2B.

The arrangement of the slot permits that locks of hair be captured in the slot and wrapped around the outside of cone by rotating the cone. The motor is reversible so that the lock of hair can be wrapped clockwise or counter clockwise.

FIGS. 3–7 show the method of forming one or more "rolls" of hair according to the invention.

Figure 3:
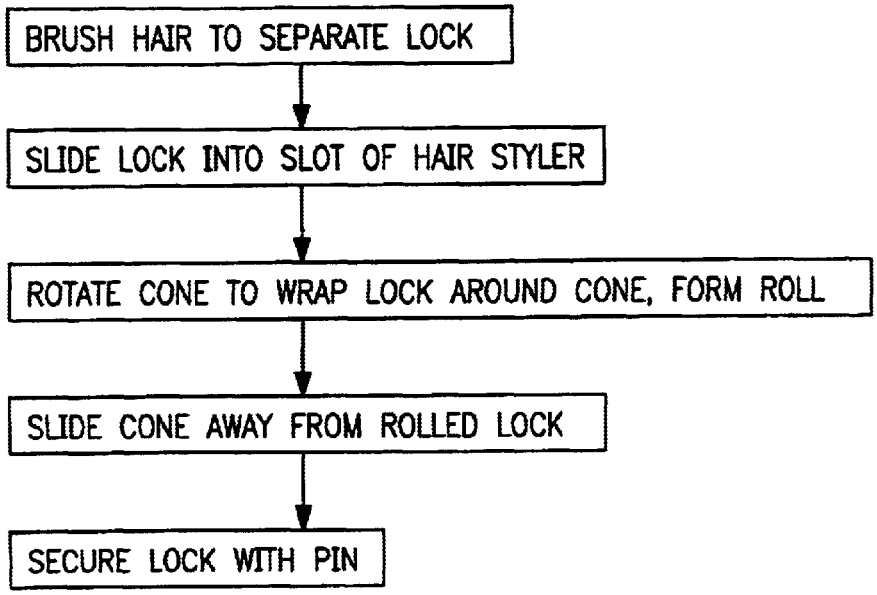
FIG. 3 lists the steps in forming a roll of hair.

FIG. 3 lists the steps in forming a "roll" of hair.

Figure 4:
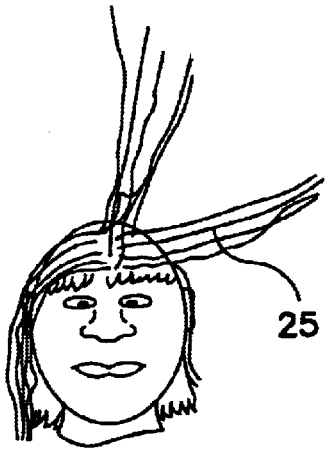
FIG. 4 shows the hair brushed to separate a lock of hair from the rest of the hair.

In step 1, the hair is brushed to separate out a lock 25 of hair as shown in FIG. 4.

Figure 5:
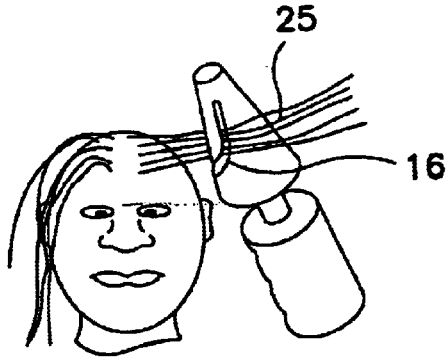
FIG. 5 shows one lock of hair captured in the slot of the cone.

In step 2, the lock of hair is captured in the slot 16 of the cone 12 as shown in FIG. 5.

Figure 6:
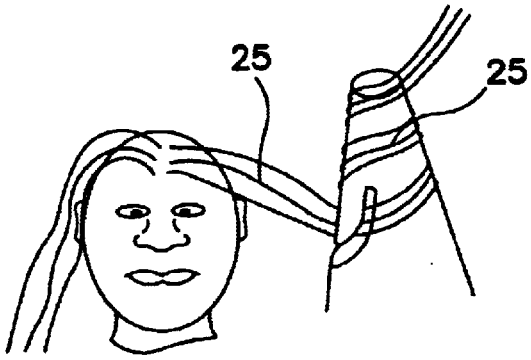
FIG. 6 shows the lock wrappted around the cone.

In step 3, the cone motor is energized to rotate the cone 12 in one direction and the length of lock 22 is guided to wrap around the cone 12 along a substantial length of the cone 12 as shown in FIG. 6.

In step 4, The cone 12 is slid free of the rolled lock 22 and the roll is secured by one or more devices (e.g., hairpin, bobbypin, rubber band). The size of the roll, (effective diameter) is generally determined by the size of the diameter of the cone.

Figure 7:
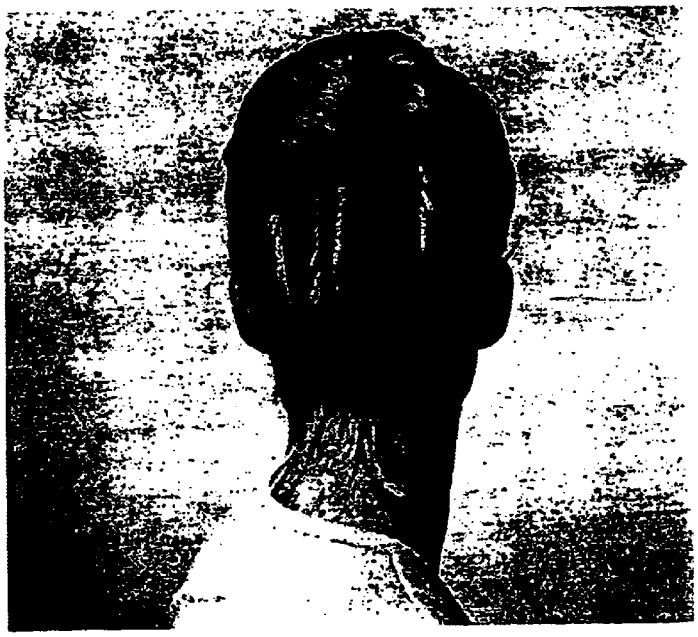
FIG. 7 shows a roll of hair.

FIG.7 shows a style of hair featuring several "rolls" of hair.

Variations of the invention include forming a plurality of rolls wherein each additional roll is formed by rotating the cone in a selected direction, clockwise or counterclockwise. Each additional roll of hair is secured in position with a device such as a hairpin, bobby pin or rubber band.

Figure 8:
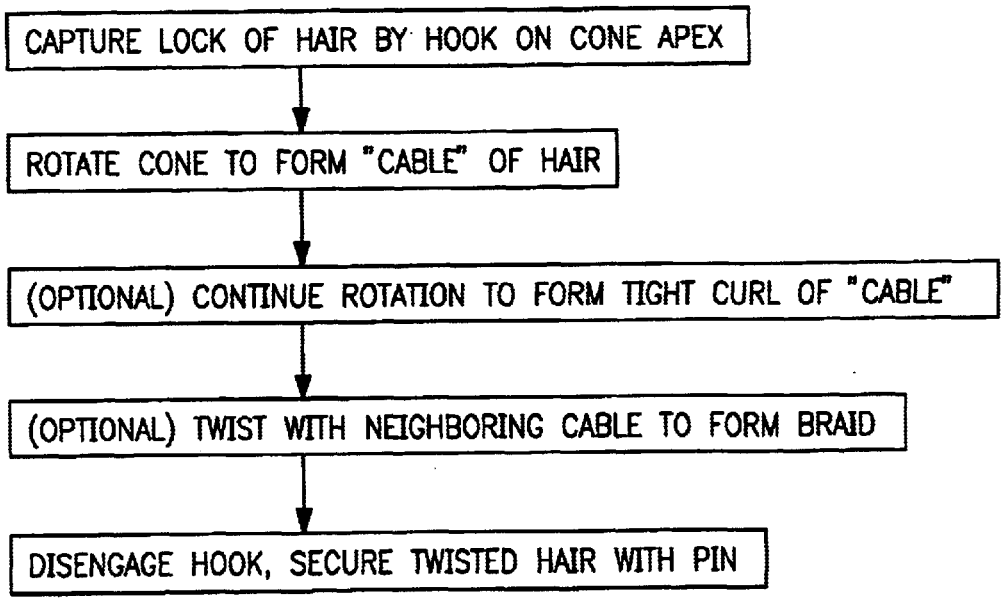
FIG. 8 lists the steps for forming a roll of hair.
Figure 9:
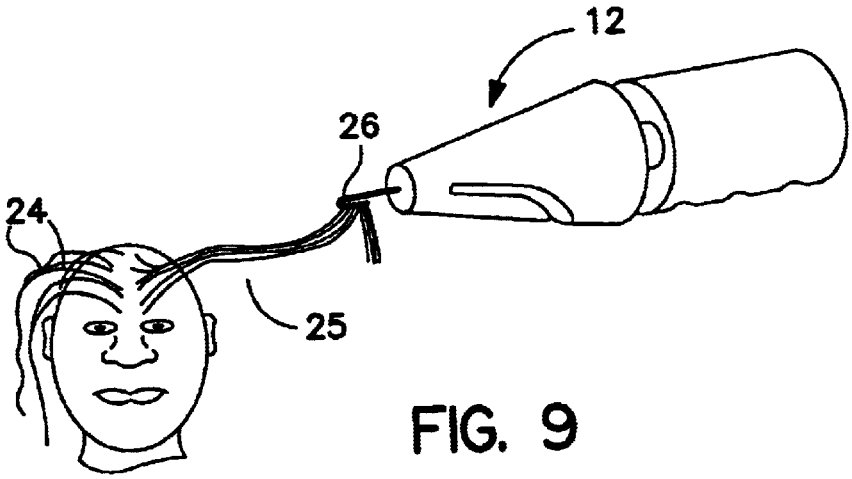
FIG. 9 shows an end of a lock of hair captured by a hook on the end of the cone.
Figure 10:
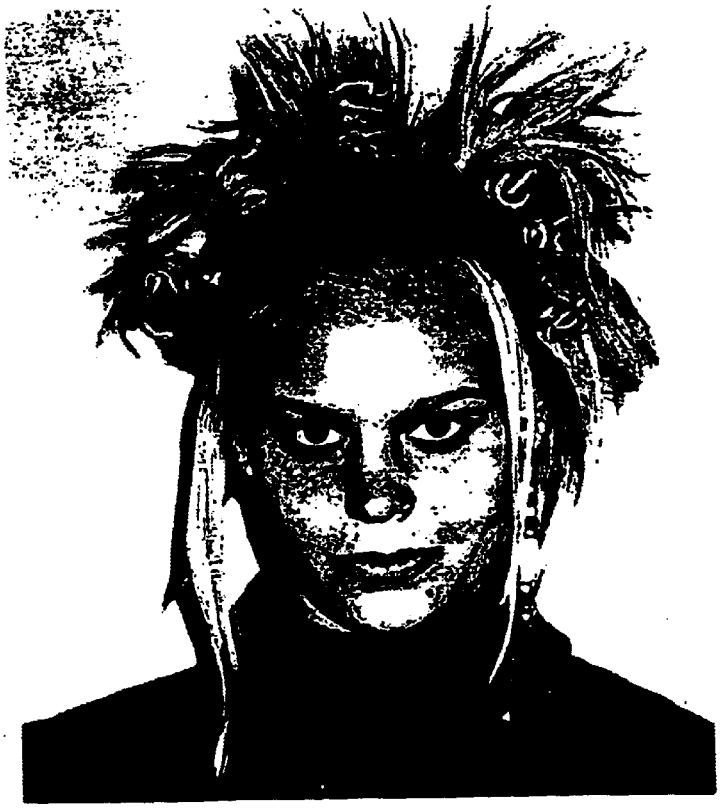
FIG. 10 shows a style of hair formed from twists of hair.

FIGS. 8–10 illustrate the method of forming a "twist" of hair

FIG. 8 lists the steps for forming a twist of hair.

In step 1, the free end of the lock of hair 25 is captured by the hook 26 on the apex of the cone 12 as shown in FIG. 9.

In step 2, the motor is energized to rotate the cone 12 forming a twist of hair as the motor rotates. The "twist" resembles a cable.

In optional step 3, after twisting the full length of the lock to form a "cable", further rotation twists the cable-like length into a tight knot.

In optional step 3, two twists (of locks of hair are formed separately but side by side and then the two twists are secured at their respective free ends to the hook and twisted together to form a braid.

In step 4, the hook is disengaged from the end of lock and the twist is secured by, e.g., a bobbypin, clip, or rubber band.

FIG. 10 shows "twists" formed in accordance with the methods of this invention.

Variations and modifications in the use of this invention may be contemplated after reading the specification and studying the drawings that are within the scope of the invention.

For example, the roll of hair can be formed with the cone oriented in selected directions (up, down, rearward, sideways,) thereby producing a variety of designs incorporating the roll.

For example, the roll of hair can be formed with the cone oriented in selected directions (up, down, rearward sideways,) thereby producing a variety of designs incorporating the roll.

The twist of hair can be on the end of a roll of hair or in the absence of a roll of hair.

Two twists of hair can be formed side by side and then twisted together to form a braid by attaching the ends of both twists to the hook and rotating the motor.

I therefore wish to define the scope of my invention by the appended claims.

I claim:

1. A hair styler which comprises:

a handle section configured for grasping by one hand;

a motor enclose in said handle section and having a motorshaft extending from said handle section;

a battery enclosed in said handle section connected to said motor through a reversing momentary switch;

said momentary switch mounted on said handle section and accessible to a user;

a cone having a conical surface and cone base;

said cone base mounted on said motor shaft and said cone having an axis aligned with said motorshaft;

said conical surface having a slot with an open end arranged to permit sliding a section of a lock of hair through said slot whereby said lock of hair wraps around said conical surface when said cone is rotated by depressing said momentary switch leaving a roll of hair after said cone is disengaged from said section of lock;

a means for engaging a lock of hair and mounted on an apex of said cone whereby said lock is twisted to form a twist of hair when said cone is rotated.

2. The hair styler of claim 1 wherein said means for engaging comprises a hook.

3. The hair styler of claim 1 wherein said means for engaging comprises a spring loaded clamp.

4. A method for forming a roll of hair which includes the steps of:

A) providing a hair styler which comprises:

a handle section configured for grasping by one hand;

a motor enclosed in said handle section and having a motorshaft extending from said handle section;

a battery enclosed in said handle section connected to said motor through a momentary switch;

said momentary switch mounted on said handle section and accessible to a user;

a cone having a conical surface, apex and cone base;

said cone base mounted on said motor shaft and said cone having an axis aligned with said motorshaft;

said conical surface having a slot with an open end arranged to permit sliding a lock of hair into said slot whereby said lock of hair wraps around said conical surface and forms a roll of hair when said cone is rotated by depressing said momentary switch;

providing said hairstyler with a means for engaging an end of said lock of hair wherein said means for engaging is one of a hook and a springloaded clamp;

B) separating a lock of hair from a remaining portion of a head of hair;

C) sliding said lock of hair through said slot;

D) rolling said lock of hair by depressing said momentary switch whereby a portion of said lock is wrapped around said conical surface and forms a roll of hair;

E) sliding said cone away from said roll of hair and securing said roll of hair with a tie;

engaging an end of a lock of hair with said means for engaging;

rotating said cone thereby forming a twist of hair on a free end of said roll of hair.

5. A method for forming a twist of hair which includes the steps of:

A) providing a hair styler which comprises:

a handle section configured for grasping by one hand;

a motor enclosed in said handle section and having a motorshaft extending from said handle sections;

a battery enclosed in said handle section connected to said motor through a momentary switch;

said momentary switch mounted on said handle section and accessible to a user;

a cone having a conical surface, apex and cone base;

said cone base mounted on said motor shaft and said cone having an axis aligned with said motorshaft;

said conical surface having a slot with an open end arranged to permit sliding a lock of hair into said slot whereby said lock of hair wraps around said conical surface and forms a roll of hair when said cone is rotated by depressing said momentary switch;

a means mounted on an apex of said cone for engaging an end of said lock of hair wherein said means for engaging is one of a hook and a springloaded clamp;

separating a lock of hair from a remaining portion of a head of hair;

C) engaging an end of said lock of hair with said means for engaging;

D) rotating said cone thereby forming a twist of hair on a free end of said roll of hair.

6. A method for forming a twist on an end of a roll of a lock of hair which comprises steps in operable order:

A) providing a hair sylerstyler which comprises:

a handle section configured for grasping by one hand;

a motor enclosed in said handle section and having a motorshaft extending from said handle section;

a battery enclosed in said handle section connected to said motor through a momentary switch;

said momentary switch mounted on said handle section and accessible to a user;

a cone having a conical surface, apex and cone base;

said cone base mounted on said motor shaft and said cone having an axis aligned with said motorshaft;

said conical surface having a slot with an open end arranged to permit sliding a lock of hair into said slot whereby said lock of hair wraps around said conical surface and forms a roll of hair when said cone is rotated by depressing said momentary switch;

a means mounted on an apex of said cone for engaging an end of said lock of hair wherein said means for engaging is one of a hook and a springloaded clamp;

B) separating a lock of hair from a remaining portion of a head of hair;

C) sliding said lock of hair through said slot;

D) rolling said lock of hair by depressing said momentary switch whereby a portion of said lock is wrapped around said conical surface and forms a roll of hair;

E) sliding said cone away from said roll of hair and securing said roll of hair with a tie;

F) engaging an end of said lock of hair extending from said roll with said means for engaging;

G) rotating said cone thereby forming a twist of hair on a free end of said roll of hair.

* * * * *